US006727445B2

(12) United States Patent
Cullinan et al.

(10) Patent No.: US 6,727,445 B2
(45) Date of Patent: Apr. 27, 2004

(54) SENSOR PADS FOR PATIENT MONITORING DEVICES

(75) Inventors: Michael F. Cullinan, Concord, NH (US); Anthony C. Greene, Concord, NH (US); John M. McAuley, Concord, NH (US)

(73) Assignee: Secure Care Products, Inc., Concord, NH (US)

( * ) Notice: Subject to any disclaimer, the term of this patent is extended or adjusted under 35 U.S.C. 154(b) by 148 days.

(21) Appl. No.: 09/882,784

(22) Filed: Jun. 14, 2001

(65) Prior Publication Data

US 2002/0189924 A1 Dec. 19, 2002

(51) Int. Cl.[7] ..... H01H 3/02
(52) U.S. Cl. ..... 200/85 R; 200/5 A
(58) Field of Search ..... 200/85 R, 5 A, 200/512–517, 5 R, 61.54, 86 R, 85 A

(56) References Cited

U.S. PATENT DOCUMENTS

| | | | | |
|---|---|---|---|---|
| 4,280,029 A | | 7/1981 | Lewis | 200/50 |
| 4,307,275 A | * | 12/1981 | Larson et al. | 200/512 |
| 4,317,011 A | * | 2/1982 | Mazurk | 200/5 A |
| 4,409,450 A | * | 10/1983 | Blades | 200/512 |
| 4,501,938 A | * | 2/1985 | Kawauchi | 200/5 A |
| 4,527,021 A | * | 7/1985 | Morikawa et al. | 200/5 A |
| 4,864,084 A | * | 9/1989 | Cardinale | 200/5 A |
| 5,137,033 A | | 8/1992 | Norton | 128/886 |
| 5,521,336 A | | 5/1996 | Buchanan et al. | 178/18 |
| 5,743,386 A | * | 4/1998 | Liao | 200/512 |
| 5,871,088 A | * | 2/1999 | Tanabe | 200/314 |
| 6,121,869 A | * | 9/2000 | Burgess | 250/208.4 |
| 6,373,008 B1 | * | 4/2002 | Saito et al. | 200/310 |

FOREIGN PATENT DOCUMENTS

| | | | |
|---|---|---|---|
| EP | 178488 | * | 9/1985 |
| EP | 322515 | * | 12/1987 |
| EP | 322514 | * | 9/1988 |
| JP | 4-28125 | * | 1/1992 |
| JP | 4028125 | * | 1/1992 |

OTHER PUBLICATIONS

Secure Care Brochure for Chair Tender and Bed Tender, REV–A Jan. 8, 1999.
Tender Pad Sample Product—In use at least as early as 1997.

* cited by examiner

*Primary Examiner*—Michael Friedhofer
*Assistant Examiner*—Lisa Klaus
(74) *Attorney, Agent, or Firm*—Hayes Soloway P.C.

(57) ABSTRACT

A pressure switch comprises a first dielectric sheet having a first and second surface; and has two half circuits carried on the first surface of said first dielectric sheet. A second dielectric sheet overlies the first dielectric sheet. The second dielectric sheet has a plurality of switch closures carried thereon and facing the first dielectric sheet. The switch closures are normally spaced from the half circuits on the first dielectric sheet, and are deflectable into contact with the half circuits under an externally applied force.

13 Claims, 4 Drawing Sheets

SENSOR PADS FOR PATIENT MONITORING DEVICES

FIELD OF THE INVENTION

The present invention relates generally to patient monitoring devices, and more particularly, to improvements in sensor pads for use with patient monitoring systems for notifying medical personnel and caregivers in the event a patient or ward leaves a bed or chair unattended.

BACKGROUND OF THE INVENTION

Patient monitoring devices are employed in hospitals and nursing homes, and the like to alert staff if a patient or ward gets out of bed or a chair unattended, (or falls out of bed or chair), or in the case of a infant, is removed from a crib by a unauthorized person. Referring to FIG. 1, a typical patient monitoring system includes a controller 10 adapted to receive a signal from a detecting pad 12 which typically is hard wired to controller 10 through line 14. Controller 10 typically includes a power switch and a display 16, and typically includes a visual and audible alarm 18. Alternatively, sensor pad 12 maybe battery powered, and include a built in radio transmitter for sending a signal to controller 10.

Referring to FIG. 2, sensor pad 12 typically comprises a pressure pad or membrane switch type sensor comprising a pair of flexible dielectric sheets or membranes 20, 22 joined to one another at their periphery 24 by an adhesive or by thermal welding. Formed inwardly of periphery 4 on facing surfaces of sheets 20 and 22 are conductor strips 26 and 28 respectfully. Conductor strips 26 and 28 typically are formed of screen printed carbon or the like and together form the two poles of a membrane or pressure switch which is normally "open", and which completes a circuit when subjected to sufficient pressure. Pad 12 also may include a pressure sensitive adhesive 30 and release sheet 32 on the back thereof so that the pad maybe fixed in place on a mattress or chair pad. Sensor pads in accordance with the foregoing are available commercially from several sources including Secure Care Products, Inc. of Concord N.H.

SUMMARY OF THE INVENTION

The present invention provides an improvement in sensor pads of the like above discussed. More particularly, the present invention provides a sensor pad in which open circuit patterns are printed on one surface of a first dielectric sheet, while a plurality of switch closures are printed on the surface of a second dielectric sheet facing the first sheet. The second dielectric sheet includes a plurality of raised areas or pods on which the switch closures are printed. The switches are in a normally open position, and are closed by pressure from the weight of a patient.

Still are the features and advantages the present invention will be seen from the following detailed description taken in conjunction with the accompanying drawings wherein:

DETAILED DESCRIPTION OF THE PREFERRED EMBODIMENT

Figure 1:
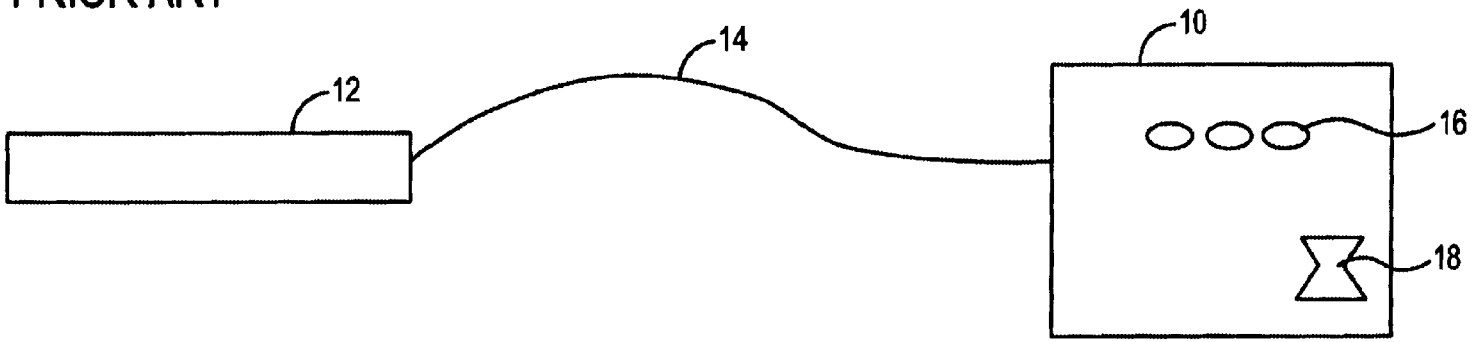
FIG. 1 PRIOR ART
FIG. 1 is a schematic view of a monitoring system in accordance with the prior art.
Figure 2:
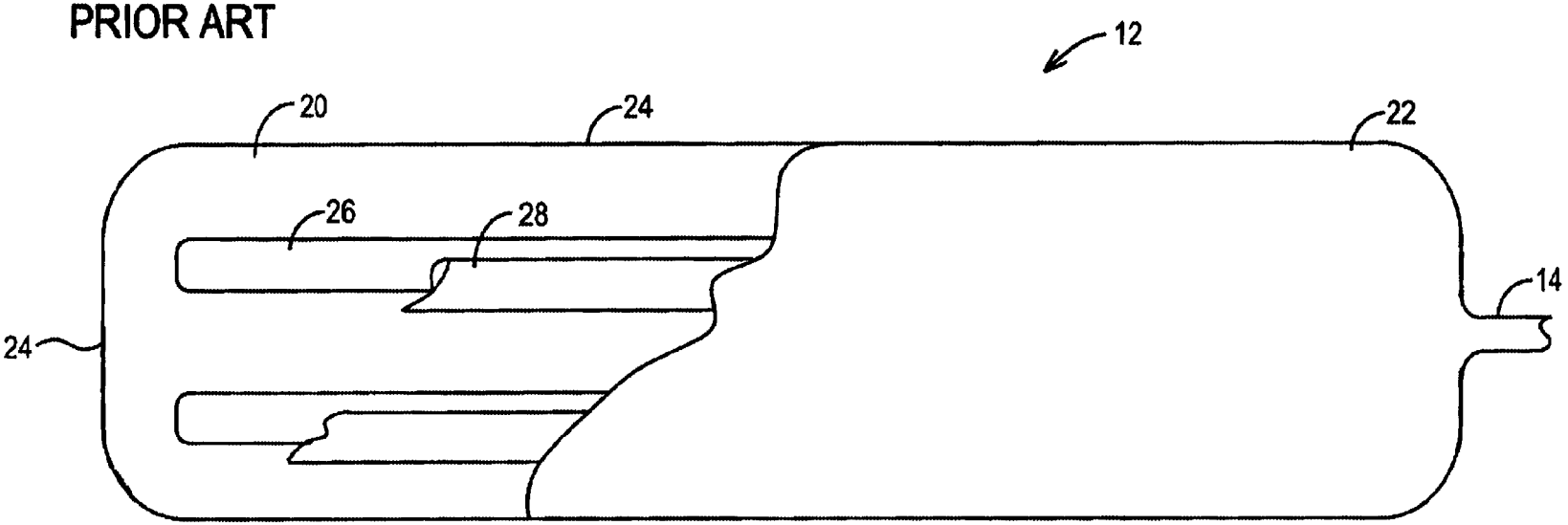
FIG. 2 PRIOR ART
FIG. 2 is a top plan view, in partial cross-section, of a prior art sensor pad.
Figure 3:
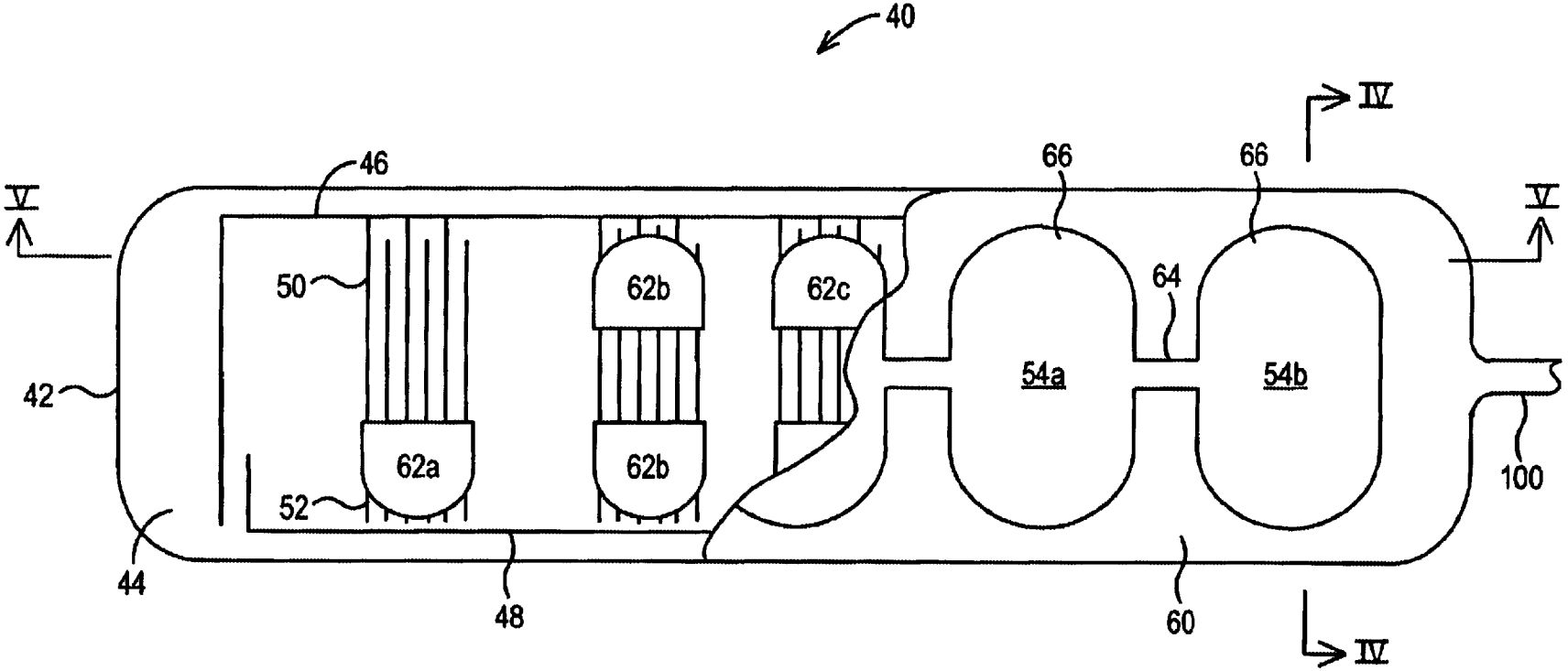
FIG. 3 is a view, similar to FIG. 2, of a sensor pad made in accordance with a preferred embodiment of the present invention.
Figure 4:
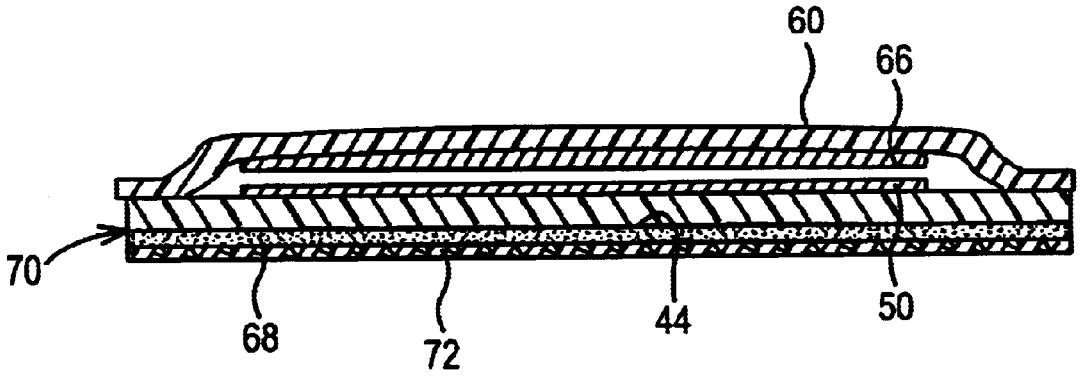
FIG. 4 is a cross-sectional view of the sensor pad of FIG. 3, taken along IV—IV.
Figure 5:
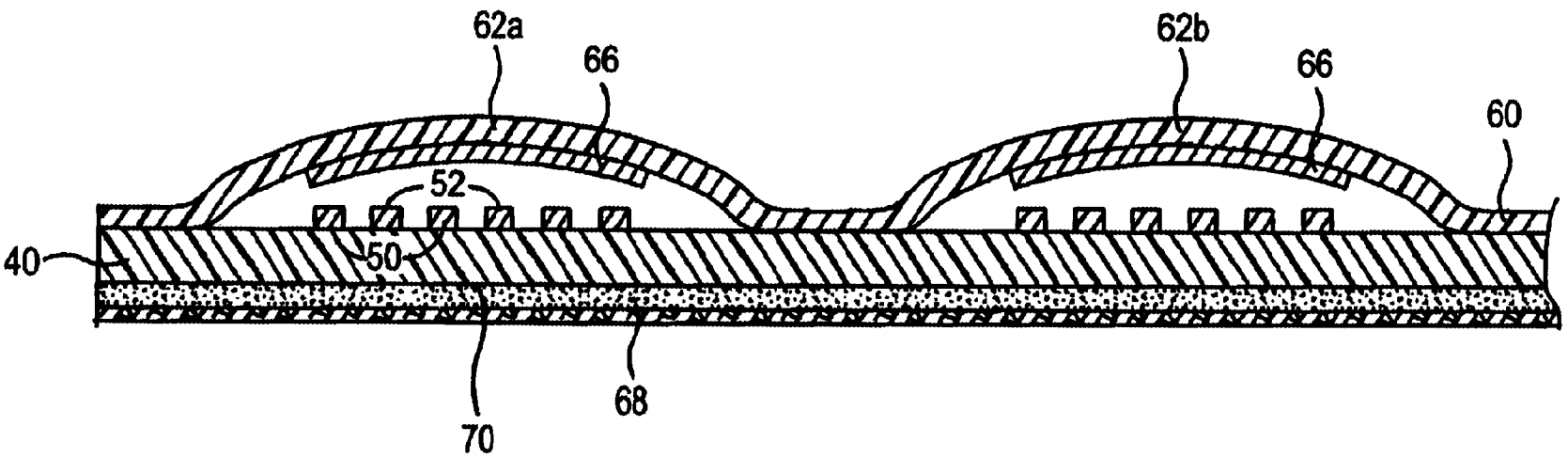
FIG. 5 is a view similar to FIG. 4, taken along V—V.

Referring to FIGS. 3–5, there is illustrated a preferred embodiment of a sensor pad made in accordance with the present invention. The pad 40 comprises a substrate 42 formed of a thin semi-rigid dielectric material such as 0.026 to 0.027 mil thick polyester sheet or the like. Carried on a surface 44 of substrate 42 is a pair of parallel running bus bars 46 formed of an electrically conductive material such as a metal foil or conductive ink. A plurality of spaced conductor strips 50, 52 also formed of a metal foil or conductive ink are formed extending from and perpendicular to bus bars 46, 48, in regular spaced groupings 54*a*, 54*b* . . . Bus bars 46 and 48 are connected through a flexible lead and plug 100 for connecting the sensor pad to a controller (not shown). Bus bars 46, 48, strips 50, 52, and the flexible lead (not shown) are all formed on substrate 42 by screen printing, or other well known printed circuit processes.

As will be appreciated, bus bars 46, 48 and strips 50, 52 formed on substrate 42 comprise two halves of a normally open circuit.

A second dielectric sheet 60 is positioned overlying substrate 42. Sheet 60 is similar in plan to substrate 40. However, unlike substrate 40 which is planar, sheet 60 comprises a plurality of raised areas or pods 62*a*, 62*b* . . . spaced regularly along a length of sheet 60 and overlying groupings 54*a*, 54*b* . . . Pods 62*a*, 62*b* . . . are connected by a raised channels 64.

Metalized pads 66 are formed on the underside surface of pods 62*a*, 62*b* . . . Sheet 60 is adhesively bonded to substrate 40 except under pods 62*a*, 62 *b* . . . and channels 64 so that pods 62*a*, 62*b* . . . and channels 64 collectively form one or more air bladders whereby pads 62*a*, 62*b* . . . are normally held spaced apart from and above strips 50, 52.

Completing the sensor pad in accordance with the present invention is a pressure sensitive adhesive 68 which is applied to the back surface 70 of substrate 40, and a release sheet 72 which overlays the adhesive 68.

Use of the sensor pad in accordance with the present invention is as follows. The release sheet 72 is striped from the pad, and the pad positioned on a mattress or chair for location under the patient. The pad is then connected to the controller. As will be appreciated, the pad is in a normally "open switch" position. However, when sufficient pressure is exerted on the pad such as by the presence of a patient in the bed or chair, one or more pods 62*a*, 62*b* . . . are deflected downward so that pads 66 make contact across two or more adjacent strips 50, 52. This completes the electrical circuit. The controller is then turned on. As long as the circuit remains completed, no alarm is sounded. However, due to the plurality of switches, normal movement of the patient in the bed or the chair will not result in an open switch condition.

Unlike some prior art pressure sensor pads which over time may compress and give false close switch signals, and/or may give false close switch signals due to the weight of pillows or blankets, the captured air under the switch pods 62*a*, 62*b* . . . provides positive pressure open switch conditions in the absence of sufficient pressure on the pads due to the weight of the patient. Thus, false close switch signals are eliminated.

Changes may be made to the above invention. For example, rather than interconnect all of the pods, the pods could be connected in groups of two or more. Also, pads can be graded for different size/weight patients by varying the size, geometry and placement of the pods and/or captured air pressure. And, conductors 50, 52 maybe formed in other patterns. Still other changes maybe made without departing from the spirit scope of the invention.

What is claimed is:

1. A patient monitoring pressure sensor pad having a pressure switch carried thereon, said pressure switch comprising:

a first semi-rigid dielectric sheet having a first and second surface;

a plurality of pairs of opposingly disposed half circuits carried on the first surface of said first dielectric sheet, each said pair comprising a first and second half circuit, wherein each said first half circuit comprises a plurality of spaced conductor strips extending from a first common bus bar in spaced groupings, and each said second half circuit comprises a plurality of spaced conductor strips extending from a second common bus bar in spaced groupings; and a second flexible dielectric sheet overlying the first dielectric sheet, said second dielectric sheet having a plurality of switch closures carried thereon and facing said first dielectric sheet, said switch closures being normally spaced from said half circuits on said first dielectric sheet, and deflectable into contact with said half circuits under an externally applied force.

2. A sensor pad according to claim 1, wherein said second dielectric sheet comprises a plurality of raised areas or pods and said switch closures are formed on the underside surface of said raised areas or pods.

3. A sensor pad according to claim 2, wherein at least two of said raised areas or pods are connected by means of a channel.

4. A sensor pad according to claim 1, and further including a pressure sensitive adhesive applied to the second surface of said first dielectric sheet, and a release sheet overlying said pressure sensitive adhesive.

5. A sensor pad according to claim 1, wherein said switch closures comprise electrically conductive pads.

6. A sensor pad according to claim 1, wherein each half circuit includes a bus bar having a plurality of spaced conductor strips extending from said bus bar in spaced groupings.

7. A sensor pad according to claim 6, wherein said space conductor strips extend perpendicularly from said bus bars.

8. A sensor pad according to claim 1, wherein said half circuits comprise screen printed circuits.

9. A sensor pad according to claim 1, and further comprising a flexible lead and plug connected to said bus bars.

10. A sensor pad according to claim 1, wherein said first semi-rigid dielectric sheet comprises a polyester sheet.

11. A sensor pad according to claim 12, wherein said first dielectric sheet comprises a polyester sheet material.

12. A patient monitoring sensor pad having a pressure switch carried thereon, said pressure switch comprising:

first and second dielectric sheets with facing surfaces;

a plurality of pairs of comb-shaped half circuits carried on a facing surface of said first dielectric sheet, said comb-shaped half circuits being inter-digitated, and each said pair comprising a first and second half circuit, wherein each said first half circuit comprises a plurality of spaced conductor strips extending from a first common bus bar in spaced groupings, and each said second half circuit comprises a plurality of spaced conductor strips extending from a second common bus bar in spaced groupings; and switch closures carried on a facing surface of said second dielectric sheet, wherein said first dielectric sheet comprises a semi-rigid dielectric sheet material, and said second dielectric sheet comprises a flexible dielectric sheet material.

13. A sensor pad according to claim 12, wherein said switch closures comprise a plurality of metalized pads held spaced apart from said comb-shaped half circuits by air bladders formed between the first and second sheets.

* * * * *